US011365373B2

(12) United States Patent
Ceulemans et al.

(10) Patent No.: US 11,365,373 B2
(45) **Date of Patent: *Jun. 21, 2022**

(54) HARD SURFACE CLEANERS COMPRISING CARBOXYLATED FRUCTAN

(71) Applicant: The Procter & Gamble Company, Cincinnati, OH (US)

(72) Inventors: Raphael Angeline Alfons Ceulemans, Holsbeek (BE); Geert Andre Deleersnyder, Wielsbeke (BE); Marina Jozefa Hermie, Hever (BE); Cindy Jean, Houdeng-Aimeries (BE); Stefanos Kantaridis, Brussels (BE); James Robert Tinlin, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/387,572

(22) Filed: Apr. 18, 2019

(65) Prior Publication Data

US 2019/0330566 A1 Oct. 31, 2019

(30) Foreign Application Priority Data

Apr. 27, 2018 (EP) ..... 18169825

(51) Int. Cl.

| | |
|---|---|
| ***C11D 1/62*** | (2006.01) |
| ***C11D 1/72*** | (2006.01) |
| ***C11D 1/825*** | (2006.01) |
| ***C11D 1/835*** | (2006.01) |
| ***C11D 3/22*** | (2006.01) |
| ***C11D 3/37*** | (2006.01) |
| ***C11D 3/48*** | (2006.01) |
| ***B08B 1/00*** | (2006.01) |
| ***B08B 3/08*** | (2006.01) |
| ***C11D 11/00*** | (2006.01) |
| *C11D 1/75* | (2006.01) |

(52) U.S. Cl.

CPC ..... *C11D 3/226* (2013.01); *B08B 1/006* (2013.01); *B08B 3/08* (2013.01); *C11D 1/825* (2013.01); *C11D 3/3723* (2013.01); *C11D 3/48* (2013.01); *C11D 11/0023* (2013.01); *C11D 1/72* (2013.01); *C11D 1/75* (2013.01)

(58) Field of Classification Search

CPC .. C11D 1/62; C11D 1/665; C11D 1/72; C11D 1/825; C11D 1/835; C11D 3/22; C11D 3/225; C11D 3/226; C11D 3/3723; C11D 3/48

See application file for complete search history.

(56) References Cited

U.S. PATENT DOCUMENTS

| | | | | |
|---|---|---|---|---|
| 7,728,124 | B2 | 6/2010 | Raaijmakers | |
| 8,343,904 | B2 | 1/2013 | Feenstra | |
| 8,758,556 | B2 | 6/2014 | Verrett | |
| 8,883,711 | B2 | 11/2014 | Leonard | |
| 2004/0014623 | A1* | 1/2004 | Kuzee | C11D 3/223 510/238 |
| 2009/0036404 | A1* | 2/2009 | MacLeod | A61L 12/143 514/54 |
| 2010/0298192 | A1* | 11/2010 | Feenstra | C11D 3/10 510/223 |
| 2012/0225948 | A1* | 9/2012 | Heisig | A01N 33/12 514/642 |
| 2015/0011748 | A1 | 1/2015 | Notte | |
| 2017/0114154 | A1* | 4/2017 | Shabelina | C11D 3/226 |
| 2018/0201880 | A1 | 7/2018 | Rivera Cruz | |

FOREIGN PATENT DOCUMENTS

EP 3263687 A1 1/2018

OTHER PUBLICATIONS

Boland, Y; "Carboxymethyl Inulin: A Multifunctional Ingredient for Eco-Friendly Detergents", SOFW Journal, Verlag Fuer Chemische Industrie H. Ziolkowsky GMBH, DE, vol. 136, No. 6, Jun. 1, 2010, pp. 38-40, XP001555933, ISSN: 0942-7694, *abstract*.

Extended European Search Report; Application No. 18169825.9-1105; dated Nov. 7, 2018; 12 pages.

* cited by examiner

*Primary Examiner* — Brian P Mruk

(74) *Attorney, Agent, or Firm* — Carolyn S. Powell

(57) ABSTRACT

The need for a hard surface cleaning composition which provides improved surface shine while maintaining cleaning efficacy, and also improves the prevention of water-marks, especially from inclined surfaces, is met by formulating the composition with low levels of surfactant and a carboxylated fructan.

8 Claims, No Drawings

HARD SURFACE CLEANERS COMPRISING CARBOXYLATED FRUCTAN

FIELD OF THE INVENTION

Hard surface cleaning compositions comprising carboxylated fructan and their use in improving shine and/or preventing water-marks on surfaces.

BACKGROUND OF THE INVENTION

Hard surface cleaning compositions are used for cleaning and treating hard surfaces. Preferably, the hard surface cleaning composition is formulated to be an "all purpose" hard surface cleaning composition. That is, the hard surface cleaning composition is formulated to be suitable for cleaning as many different kinds of surfaces as possible.

The formulators of such hard surface cleaning compositions aim to provide the overall best experience to the consumer by creating compositions providing multiple benefits, such as good cleaning and good shine, altogether. However, the technical means of providing these benefits can be contradictory. For instance, improving cleaning typically requires higher levels of surfactant or other cleaning ingredients while improving shine typically requires lower levels of such ingredients since they leave residues on the surface which disperse light reflecting from the surface, even when soft water is used for cleaning.

In addition, water-marks reduce surface shine. Such water-marks are typically formed from the precipitation of insoluble calcium salts as hard water dries on surfaces, and can be spread evenly across the treated surface or as circular marks where water droplets have evaporated. In addition, hard surface cleaning compositions are typically diluted in water before use in treating surfaces. When hard water is used, this can also lead to calcium deposits being left on the treated surface, leading to such unsightly water-marks. Typically, such water-marks are removed using an acid cleaner. However, such acid cleaners are typically harsh on surfaces, and also less effective than alkali cleaners for overall cleaning, especially grease removal. Hence, preventing such water-marks simplifies cleaning and also improves surface shine. Furthermore, preventing water-marks on inclined surfaces is particularly challenging since the liquid cleaning composition tends to run down the surface before it has had time to fully act on the surface.

As such, a need remains for a hard surface cleaning composition which provides improved surface shine while maintaining cleaning efficacy, and also improves the prevention of water-marks, especially from inclined surfaces, when using soft water or hard water for cleaning.

WO2010/106077A1 relates to a method for inhibiting the formation, deposition and adherence of calcium salt scale to metallic and other surfaces in the equipment, vessels and/or piping of a chemical pulp process facility comprising adding an effective scale inhibiting amount of a composition to the alkaline aqueous mixture in the digester of said chemical pulping process, wherein said composition consists of at least one phosphonate component and at least one component consisting of at least one carboxylated fructan compound. WO2005/073256A1 relates to a method for the manufacture of carboxyalkylinulin comprising preparing an aqueous medium containing dispersed therein a halogenoalkylcarboxylate, adding to the carboxylate containing medium, under substantially neutral pH conditions, an inulin followed by heating this mixture to a temperature in the range of from 60° C. to 90° C., and proceeding with the reaction at alkaline conditions, pH 8-12, while simultaneously adding additional halogenoalkylcarboxylate and alkalihydroxide. The carboxyalkylinulin so formed is recovered in a manner known per sé. WO2013/117672A1 relates to a method is for the manufacture of aqueous solutions of alkali metal salt of carboxymethyl fructan. More specifically a method for the manufacture of aqueous solutions including at least 20% by weight of alkali metal salt of carboxymethyl fructan having a degree of carboxymethyl substitution of at least 1.2. WO2015/144438A1 relates to a carboxylate ester of polysaccharide characterised in that it possesses ester bonds with trimellitic anhydride and is soluble in water. The polysaccharide is esterified with trimellitic anhydride and the degree of substitution of the polysaccharide lies in the range of from 0.5 to 3. The invention further relates to methods for the manufacture of these polysaccharides esters in organic solvents, in water or in an extruder or a kneader and to their use in fabric and home care formulations.

SUMMARY OF THE INVENTION

The present invention relates to a hard surface cleaning composition comprising: from 0.01% to 10% by weight of a surfactant system; and a carboxylated fructan. The present invention further relates to a method of cleaning a hard surface, comprising the steps of: providing a hard surface cleaning composition according to any preceding claims; applying the hard surface cleaning composition to the hard surface; and optionally rinsing and/or wiping the surface. The present invention further relates to the use of a hard surface cleaning composition comprising a carboxylated fructan for improving surface shine.

DETAILED DESCRIPTION OF THE INVENTION

The hard surface cleaning compositions of the present invention provide improved surface shine while maintaining cleaning efficacy, and also improves the prevention of water-marks, especially from inclined surfaces.

As defined herein, "essentially free of" a component means that no amount of that component is deliberately incorporated into the respective premix, or composition. Preferably, "essentially free of" a component means that no amount of that component is present in the respective premix, or composition.

As used herein, "isotropic" means a clear mixture, having little or no visible haziness, phase separation and/or dispersed particles, and having a uniform transparent appearance.

As defined herein, "stable" means that no visible phase separation is observed for a composition kept at 25° C. for a period of at least two weeks, or at least four weeks, or greater than a month or greater than four months, as measured using the Floc Formation Test, described in USPA 2008/0263780 A1.

All percentages, ratios and proportions used herein are by weight percent of the composition, unless otherwise specified. All average values are calculated "by weight" of the composition, unless otherwise expressly indicated.

All measurements are performed at 25° C. unless otherwise specified.

Unless otherwise noted, all component or composition levels are in reference to the active portion of that component or composition, and are exclusive of impurities, for example, residual solvents or by-products, which may be present in commercially available sources of such components or compositions.

Liquid Hard Surface Cleaning Compositions:

By "liquid hard surface cleaning composition", it is meant herein a liquid composition for cleaning hard surfaces found in households, especially domestic households. Surfaces to be cleaned include kitchens and bathrooms, e.g., floors, walls, tiles, windows, cupboards, sinks, showers, shower plastified curtains, wash basins, WCs, fixtures and fittings and the like made of different materials like ceramic, vinyl, no-wax vinyl, linoleum, melamine, glass, steel, kitchen work surfaces, any plastics, plastified wood, metal or any painted or varnished or sealed surface and the like. Household hard surfaces also include household appliances including, but not limited to refrigerators, freezers, washing machines, automatic dryers, ovens, microwave ovens, dishwashers and so on. Such hard surfaces may be found both in private households as well as in commercial, institutional and industrial environments.

In a preferred embodiment, the liquid compositions herein are aqueous compositions. Therefore, they may comprise from 30% to 99.5% by weight of the total composition of water, preferably from 50% to 98% and more preferably from 80% to 97%.

For improved cleaning, especially of greasy soil, the compositions of the present invention can have a pH which is greater than 7.0, measured on the neat composition, at 25° C., preferably from 7.0 to 12, more preferably from 7.5 to 11.5, even more preferably from 9.5 to 11.3, most preferably 10 to 11. It is believed that the greasy soil and particulate greasy soil cleaning performance is further improved at these preferred alkaline pH ranges. Accordingly, the compositions herein may further comprise an acid or base to adjust pH as appropriate.

A suitable acid of use herein is an organic and/or an inorganic acid. A preferred organic acid of use herein has a pKa of less than 6. A suitable organic acid is selected from the group consisting of: citric acid, lactic acid, glycolic acid, succinic acid, glutaric acid and adipic acid and mixtures thereof. A suitable inorganic acid can be selected from the group consisting of: hydrochloric acid, sulphuric acid, phosphoric acid and mixtures thereof.

A typical level of such acids, when present, is from 0.001% to 5.0% by weight of the total composition, preferably from 0.002% to 3.0% and more preferably from 0.005% to 1.5%.

A suitable base to be used herein is an organic and/or inorganic base. Suitable bases of use herein are the caustic alkalis, such as sodium hydroxide, potassium hydroxide and/or lithium hydroxide, and/or the alkali metal oxides such, as sodium and/or potassium oxide or mixtures thereof. A preferred base is a caustic alkali, more preferably sodium hydroxide and/or potassium hydroxide.

Other suitable bases include ammonia, ammonium carbonate, potassium carbonate, sodium carbonate, sodium bicarbonate, and alkanolamines (such as monoethanolamine, triethanolamine, aminomethylpropanol, and mixtures thereof), nitrogenous buffers, and mixtures thereof. Suitable nitrogenous buffers include: ammonium or alkaline earth carbamates, guanidine derivatives, ammonium carbonate, ammonium bicarbonate, diammonium carbonate, ammonium hydroxide, ammonia (which forms ammonium hydroxide in situ when added to water) and mixtures thereof.

Typical levels of such bases, when present, are from 0.01% to 5.0% by weight of the total composition, preferably from 0.05% to 3.0% and more preferably from 0.1% to 2.0%.

All ratios are calculated as a weight/weight level, unless otherwise specified.

Surfactant System:

The hard surface cleaning composition comprises from 0.01% to 10% by weight of a surfactant system, or from 0.5% to 7.5%. preferably from 1.0% to 5.0%, more preferably from 1.5% to 3.0% by weight of the surfactant system.

Nonionic Surfactant:

The surfactant system can comprise nonionic surfactant. Suitable nonionic surfactant can be selected from the group consisting of: alkoxylated nonionic surfactants, amine oxide surfactant, alkyl polyglycosides, and mixture thereof. Preferably, the nonionic surfactant is selected from the group consisting of: alkoxylated nonionic surfactant, amine oxide surfactant, and mixtures thereof. More preferably, the nonionic surfactant comprises a combination of alkoxylated nonionic surfactant and amine oxide surfactant.

A particularly preferred surfactant system comprises: from 0.1% to 4.5%, preferably from 0.5% to 3.5%, more preferably from 1.0% to 2.5% by weight of the composition of alkoxylated nonionic surfactant, preferably ethoxylated alcohol; and from 0.005% to 2.0%, preferably from 0.01% to 1.0%, more preferably from 0.05% to 0.5% by weight of the composition of amine oxide surfactant.

Suitable alkoxylated nonionic surfactants include primary $C_6$-$C_{16}$ alcohol polyglycol ether i.e. ethoxylated alcohols having 6 to 16 carbon atoms in the alkyl moiety and 4 to 30 ethylene oxide (EO) units. When referred to for example $C_{9-14}$ it is meant average carbons and alternative reference to for example EO8 is meant average ethylene oxide units.

Suitable alkoxylated nonionic surfactants are according to the formula RO-$(A)_n$H, wherein: R is a $C_6$ to $C_{18}$, preferably a $C_8$ to $C_{16}$, more preferably a $C_8$ to $C_{12}$ alkyl chain, or a $C_6$ to $C_{28}$ alkyl benzene chain; A is an ethoxy or propoxy or butoxy unit, and wherein n is from 1 to 30, preferably from 1 to 15 and, more preferably from 4 to 12 even more preferably from 5 to 10. Preferred R chains of use herein are the $C_8$ to $C_{22}$ alkyl chains. Even more preferred R chains of use herein are the $C_9$ to $C_{12}$ alkyl chains. R can be linear or branched alkyl chain.

Suitable ethoxylated nonionic surfactants of use herein are Dobanol® 91-2.5 (HLB=8.1; R is a mixture of $C_9$ and $C_{11}$ alkyl chains, n is 2.5), Dobanol® 91-10 (HLB=14.2; R is a mixture of $C_9$ to $C_{11}$ alkyl chains, n is 10), Dobanol® 91-12 (HLB=14.5; R is a mixture of $C_9$ to $C_{11}$ alkyl chains, n is 12), Greenbentine DE80 (HLB=13.8, 98 wt % C10 linear alkyl chain, n is 8), Marlipal 10-8 (HLB=13.8, R is a C10 linear alkyl chain, n is 8), Lialethl® 11-5 (R is a $C_{11}$ alkyl chain, n is 5), Isalchem® 11-5 (R is a mixture of linear and branched C11 alkyl chain, n is 5), Lialethl® 11-21 (R is a mixture of linear and branched C11 alkyl chain, n is 21), Isalchem® 11-21 (R is a $C_{11}$ branched alkyl chain, n is 21), Empilan® KBE21 (R is a mixture of $C_{12}$ and $C_{14}$ alkyl chains, n is 21) or mixtures thereof. Preferred herein are Dobanol® 91-5, Neodol® 11-5, Lialethl® 11-21 Lialethl® 11-5 Isalchem® 11-5 Isalchem® 11-21 Dobanol® 91-8, or Dobanol® 91-10, or Dobanol® 91-12, or mixtures thereof. These Dobanol®/Neodol® surfactants are commercially available from SHELL. These Lutensol® surfactants are commercially available from BASF and these Tergitol® surfactants are commercially available from Dow Chemicals.

Suitable chemical processes for preparing the alkoxylated nonionic surfactants of use herein include condensation of corresponding alcohols with alkylene oxide, in the desired proportions. Such processes are well known to the person skilled in the art and have been extensively described in the art, including the OXO process and various derivatives thereof. Suitable alkoxylated fatty alcohol nonionic surfactants, produced using the OXO process, have been marketed under the tradename NEODOL® by the Shell Chemical Company. Alternatively, suitable alkoxylated nonionic surfactants can be prepared by other processes such as the Ziegler process, in addition to derivatives of the OXO or Ziegler processes.

Preferably, said alkoxylated nonionic surfactant is a $C_{9-11}$ EO5 alkylethoxylate, $C_{12-14}$ EO5 alkylethoxylate, a $C_{11}$ EO5 alkylethoxylate, $C_{12-14}$ EO21 alkylethoxylate, or a $C_{9-11}$ EO8 alkylethoxylate or a mixture thereof. Most preferably, said alkoxylated nonionic surfactant is a $C_{11}$ EO5 alkylethoxylate or a $C_{9-11}$ EO8 alkylethoxylate or a mixture thereof.

The composition can comprise from 0.1% to 4.5%, preferably from 0.5% to 3.5%, more preferably from 1.0% to 2.5% by weight of the composition of alkoxylated nonionic surfactant, preferably ethoxylated alcohol.

Suitable amine oxide surfactants include: $R_1R_2R_3NO$ wherein each of $R_1$, $R_2$ and $R_3$ is independently a saturated or unsaturated, substituted or unsubstituted, linear or branched hydrocarbon chain having from 10 to 30 carbon atoms. Preferred amine oxide surfactants are amine oxides having the following formula: $R_1R_2R_3NO$ wherein $R_1$ is an hydrocarbon chain comprising from 1 to 30 carbon atoms, preferably from 6 to 20, more preferably from 8 to 16 and wherein $R_2$ and $R_3$ are independently saturated or unsaturated, substituted or unsubstituted, linear or branched hydrocarbon chains comprising from 1 to 4 carbon atoms, preferably from 1 to 3 carbon atoms, and more preferably are methyl groups. $R_1$ may be a saturated or unsaturated, substituted or unsubstituted linear or branched hydrocarbon chain.

A highly preferred amine oxide is $C_{12}$-$C_{14}$ dimethyl amine oxide, commercially available from Albright & Wilson, $C_{12}$-$C_{14}$ amine oxides commercially available under the trade name Genaminox® LA from Clariant or AROMOX® DMC from AKZO Nobel.

The composition can comprise from 0.005% to 2.0%, preferably from 0.01% to 1.0%, more preferably from 0.05% to 0.5% by weight of the composition of amine oxide surfactant.

Pyrrolidone-based surfactants are also suitable nonionic surfactants. Pyrrolidone-based surfactants, including alkyl pyrrolidones, are well known and their use and methods of making them have been extensively reviewed (for instance in Pyrrolidone-based surfactants (a literature review), Login, R. B. J Am Oil Chem Soc (1995) 72: 759-771). Such alkyl pyrrolidones have been found to provide improved soapy grease scum removal as well as water-mark removal, even when used in the alkaline hard surface cleaning compositions of the present invention.

Suitable alkyl pyrrolidones can have the formula:

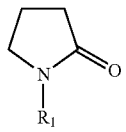

wherein $R_1$ is C6-C20 alkyl, or $R_2NHCOR_3$, and $R_2$ is C1-6 alkyl and $R_3$ is C6-20 alkyl. R1 is preferably C6-C20 alkyl. N-alkyl pyrrolidones are particularly suitable for use in compositions of the present invention, with N-alkyl-2-pyrrolidones being particularly suited. Suitable alkylpyrrolidones include N-alkyl-2-pyrrolidones, wherein the alkyl chain is C6 to C20, or C6 to C10, or C8. N-octyl-2-pyrrolidone is particularly preferred for their efficacy in removing limescale based stains, even when used in alkaline compositions. The alkyl chain can be substituted, though unsubstituted alkyl pyrrolidones are preferred. The alkyl chain is preferably fully saturated.

The alkyl pyrrolidone can be present at a level of from 0.1 to 10%, preferably from 0.5 to 5%, more preferably from 1.0 to 3.0% by weight of the composition.

Suitable alkyl pyrrolidones are marketed under the tradename Surfadone® by the Ashland Inc., such as Surfadone LP-100 (N-octyl-2-pyrrolidone) and LP-300 (N-docedycl-2-pyrrolidone), and is also available from BASF.

Alkyl polyglycosides are biodegradable nonionic surfactants which are well known in the art. Suitable alkyl polyglycosides can have the general formula $C_nH_{2n+1}O(C_6H_{10}O_5)_xH$ wherein n is preferably from 9 to 16, more preferably 11 to 14, and x is preferably from 1 to 2, more preferably 1.3 to 1.6. Such alkyl polyglycosides provide a good balance between anti-foam activity and detergency. Alkyl polyglycoside surfactants are commercially available in a large variety. An example of a very suitable alkyl poly glycoside product is Planteren APG 600, which is essentially an aqueous dispersion of alkyl polyglycosides wherein n is about 13 and x is about 1.4.

The composition can comprise from 0.1% to 4.5%, preferably from 0.5% to 3.5%, more preferably from 1.0% to 2.5% by weight of the composition of alkyl polyglycoside surfactant.

The nonionic surfactant is preferably a low molecular weight nonionic surfactant, having a molecular weight of less than 950 g/mol, more preferably less than 500 g/mol.

Anionic Surfactant:

The surfactant system can further comprise anionic surfactant. The anionic surfactant can be selected from the group consisting of: alkyl sulphate, alkyl alkoxylated sulphate, sulphonic acid or sulphonate surfactant, carboxylated anionic surfactant, and mixtures thereof, more preferably sulphonic acid or sulphonate surfactant, most preferably linear alkyl benzene sulphonate.

The anionic surfactant can be present at a level of from 0.05% to 2.0%, preferably from 0.1% to 1.0%, more preferably from 0.2% to 0.5% by weight of the composition.

Suitable alkyl sulphates of use herein include water-soluble salts or acids of the formula $ROSO_3M$ wherein R is a $C_6$-$C_{18}$ linear or branched, saturated or unsaturated alkyl group, preferably a $C_8$-$C_{16}$ alkyl group and more preferably a $C_{10}$-$C_{16}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like).

Particularly suitable linear alkyl sulphates include $C_{12-14}$ alkyl sulphate like EMPICOL® 0298/, EMPICOL® 0298/F or EMPICOL® XLB commercially available from Huntsman. By "linear alkyl sulphate" it is meant herein a non-substituted alkyl sulphate wherein the linear alkyl chain comprises from 6 to 16 carbon atoms, preferably from 8 to 14 carbon atoms, and more preferably from 10 to 14 carbon atoms, and wherein this alkyl chain is sulphated at one terminus.

Suitable sulphonated anionic surfactants of use herein are all those commonly known by those skilled in the art. Preferably, the sulphonated anionic surfactants of use herein are selected from the group consisting of: alkyl sulphonates; alkyl aryl sulphonates; naphthalene sulphonates; alkyl alkoxylated sulphonates; and $C_6$-$C_{16}$ alkyl alkoxylated linear or branched diphenyl oxide disulphonates; and mixtures thereof.

Suitable alkyl sulphonates of use herein include water-soluble salts or acids of the formula $RSO_3M$ wherein R is a $C_6$-$C_{18}$ linear or branched, saturated or unsaturated alkyl group, preferably a $C_8$-$C_{16}$ alkyl group and more preferably a $C_{10}$-$C_{16}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like).

Suitable alkyl aryl sulphonates of use herein include water-soluble salts or acids of the formula $RSO_3M$ wherein R is an aryl, preferably a benzyl, substituted by a $C_6$-$C_{18}$ linear or branched saturated or unsaturated alkyl group, preferably a $C_8$-$C_{16}$ alkyl group and more preferably a $C_{10}$-$C_{16}$ alkyl group, and M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like).

Particularly suitable linear alkyl sulphonates include $C_{12}$-$C_{16}$ paraffin sulphonate like Hostapur® SAS commercially available from Clariant. Particularly preferred alkyl aryl sulphonates are alkyl benzene sulphonates commercially available under trade name Nansa® available from Huntsman.

By "linear alkyl sulphonate" it is meant herein a non-substituted alkyl sulphonate wherein the alkyl chain comprises from 6 to 18 carbon atoms, preferably from 8 to 16 carbon atoms, and more preferably from 10 to 16 carbon atoms, and wherein this alkyl chain is sulphonated at one terminus.

Suitable alkoxylated sulphonate surfactants of use herein are according to the formula $R(A)_mSO_3M$, wherein R is an unsubstituted $C_6$-$C_{18}$ alkyl, hydroxyalkyl or alkyl aryl group, having a linear or branched $C_6$-$C_{18}$ alkyl component, preferably a $C_8$-$C_{16}$ alkyl or hydroxyalkyl, more preferably $C_{12}$-$C_{16}$ alkyl or hydroxyalkyl, and A is an ethoxy or propoxy or butoxy unit, and m is greater than zero, typically between 0.5 and 6, more preferably between 0.5 and 3, and M is H or a cation which can be, for example, a metal cation (e.g., sodium, potassium, lithium, calcium, magnesium, etc.), ammonium or substituted-ammonium cation. Alkyl ethoxylated sulphonates, alkyl butoxylated sulphonates as well as alkyl propoxylated sulphonates are contemplated herein. Specific examples of substituted ammonium cations include methyl-, dimethyl-, trimethyl-ammonium and quaternary ammonium cations, such as tetramethyl-ammonium, dimethyl piperidinium and cations derived from alkanolamines such as ethylamine, diethylamine, triethylamine, mixtures thereof, and the like.

Exemplary surfactants are $C_{12}$-$C_{18}$ alkyl polyethoxylate (1.0) sulphonate ($C_{12}$-$C_{18}$E(1.0)SM), $C_{12}$-$C_{18}$ alkyl polyethoxylate (2.25) sulphonate ($C_{12}$-$C_{18}$E(2.25)SM), $C_{12}$-$C_{18}$ alkyl polyethoxylate (3.0) sulphonate ($C_{12}$-$C_{18}$E(3.0)SM), and $C_{12}$-$C_{18}$ alkyl polyethoxylate (4.0) sulphonate ($C_{12}$-$C_{18}$E(4.0)SM), wherein M is conveniently selected from sodium and potassium. Particularly suitable alkoxylated sulphonates include alkyl aryl polyether sulphonates like Triton X-200® commercially available from Dow Chemical.

Preferably said sulphated or sulphonated anionic surfactant of use herein is selected from the group consisting of alkyl sulphates (AS) preferably $C_{12}$, $C_{13}$, $C_{14}$ and $C_{15}$ AS, sodium linear alkyl sulphonate (NaLAS), sodium paraffin sulphonate $NaPC_{12-16}S$, and mixtures thereof. Most preferably sulphated or sulphonated anionic surfactant of use herein is selected from the group consisting of alkyl sulphates (AS) preferably, $C_{12}$, $C_{13}$, $C_{14}$ and $C_{15}$ AS, sodium linear alkyl sulphonate (NaLAS), sodium paraffin sulphonate $NaPC_{12-16}S$ and mixtures thereof.

Typically, the liquid composition herein may comprise from 0.5% to 5.5% by weight of the total composition of said sulphated or sulphonated anionic surfactant, preferably from 1.0% to 5.0%, more preferably from 1.5% to 3.5% and most preferably from 2.0% to 3.0%.

Suitable carboxylated anionic surfactant include fatty acids (and salts thereof), polycarboxylated anionic surfactants, alkyl ether carboxylates, alkyl polycarboxylated anionic surfactants, alkyl ether carboxylates, alkyl polyglycosides ether carboxylates, and mixtures thereof. Polycarboxylated anionic surfactants are particularly preferred since they result compositions which improve oil emulsification, improve greasy soap scum removal, and also improve surface shine. Polycarboxylated anionic surfactants also improve sequestration of transition metal ions.

Suitable fatty acids include the alkali salts of a $C_8$-$C_{24}$ fatty acid. Such alkali salts include the metal fully saturated salts like sodium, potassium and/or lithium salts as well as the ammonium and/or alkylammonium salts of fatty acids, preferably the sodium salt. Preferred fatty acids of use herein contain from 8 to 22, preferably from 8 to 20 and more preferably from 8 to 18 carbon atoms. Suitable fatty acids may be selected from caprylic acid, capric acid, lauric acid, myristic acid, palmitic acid, stearic acid, oleic acid, and mixtures of fatty acids suitably hardened, derived from natural sources such as plant or animal esters (e.g., palm oil, olive oil, coconut oil, soybean oil, castor oil, tallow, ground oil, fish oils and/or babassu oil). For example coconut fatty acid is commercially available from KLK OLEA under the name PALMERA B1211.

Suitable polycarboxylated anionic surfactants are described in U.S. Pat. No. 5,376,298, EP0129328, WO03018733, and U.S. Pat. No. 5,120,326. Particularly preferred are polyalkoxylate polycarboxylate surfactant, for instance, as described from column 3, line 30 to column 4, line 34 of U.S. Pat. No. 5,376,298.

Suitable polyalkoxylate polycarboxylates surfactant can have the empirical formula:

$$R—O—(CH(x)—CH(y)—O)_n—R^1$$

wherein R is a hydrophobic group, preferably a substituted, or unsubstituted, hydrocarbon group typically containing from 6 to 16 carbon atoms, preferably from 8 to 14 carbon atoms, x and y are each independently selected from the group consisting of hydrogen, methyl, and succinic acid radicals, with the proviso that at least one x or y moiety per molecule is a succinic acid radical, wherein n is between 1 and 60, and wherein $R^1$ is hydrogen, substituted hydrocarbon, unsubstituted hydrocarbon preferably having between 1 and 8 carbon atoms, sulfuric, or sulfonic radical, with any acid groups being neutralized by compatible cationic groups, e.g., sodium, potassium, alkanolammonium, magnesium, etc.

Suitable polyalkoxylate polycarboxylates surfactant can have the empirical formula:

$$R—O—(C_2H_4O)_x—[CH(L)CH(L)]_y—[CH_2CH(CH_3)O)_zQ$$

wherein R is a hydrocarbon hydrophobic group, preferably alkyl, containing from 6 to 16, preferably from 8 to 14 carbon atoms; x is a number from 0 to 60, preferably from 4 to 50, more preferably from 6 to 50; L is either a C1-3 alkyl group or a group having the formula $—CH—(COO^-)CH_2(COO^-)$, with at least one L group in each molecule being $—CH(COO^-)CH_2(COO^-)$; y is a number from 1 to 12, preferably from 2 to 10, more preferably from 3 to 8; z is a number from 0 to 20, preferably from 0 to 15, more preferably from 0 to 10; and Q is selected from the group consisting of H and sulfonate groups, the compound being rendered electrically neutral by the presence of cationic groups, preferably selected from the group consisting of sodium, potassium, and substituted ammonium, e.g., monoethanol ammonium, cations. Specific examples of such polyalkoxylate polycarboxylate surfactant include the following: Poly-Tergent® C9-51B (CS-1) (x=12; y=8; and Z=17); Poly-Tergent® C9-62P (x=4; y=3; and z=17); Poly-Tergent® C9-74P (x=10; y=3.5; and Z=3.5); and Poly-Tergent® C9-92 (x=approximately 55; y=6.5; and z=0). R is believed to be an alkyl group such as a linear C9 alkyl group, and Q is believed to be H. The Poly-Tergent® surfactants are now sold under the Plurafac® trade name by BASF.

Suitable polycarboxylated anionic surfactants include alkoxylated polymer, alkyl ether, alkanedioic acid salts, for instance, as sold those under the Plurafac™ CS-10 tradename by BASF. Suitable alkyl ether carboxylates include laureth-5 carboxylate, available under the tradename of Empicol® CED 5 from Huntsman. Suitable alkyl ether carboxylates are described in WO2002/036081A1, from page 4 line 8 to page 5 line 10. Suitable alkyl polyglycosides ether carboxylates include EUCAROL AGE/ET (INCI: sodium coco-glucoside tartrate), EUCAROL AGE/EC INCI: disodium coco-glucoside citrate) and are described in WO1997/042299A1.

Where the composition comprises a quaternary antimicrobial agent, the composition preferably comprises less than 0.1% of anionic surfactant, and is more preferably free of anionic surfactant.

Additional Surfactant:

The hard surface cleaning composition may comprise an additional surfactant, preferably selected from: an amphoteric, zwitterionic, and mixtures thereof. The hard surface cleaning composition can comprise from 0.5% to 3%, or from 0.5% to 2% by weight of the additional surfactant.

Suitable zwitterionic surfactants typically contain both cationic and anionic groups in substantially equivalent proportions so as to be electrically neutral at the pH of use. The typical cationic group is a quaternary ammonium group, other positively charged groups like phosphonium, imidazolium and sulfonium groups can be used. The typical anionic hydrophilic groups are carboxylates and sulfonates, although other groups like sulfates, phosphonates, and the like can be used.

Some common examples of zwitterionic surfactants (such as betaine/sulphobetaine surfactants) are described in U.S. Pat. Nos. 2,082,275, 2,702,279 and 2,255,082. For example, Coconut dimethyl betaine is commercially available from Seppic under the trade name of Amonyl 265®. Lauryl betaine is commercially available from Albright & Wilson under the trade name Empigen BB/L®. A further example of betaine is Lauryl-imminodipropionate commercially available from Rhodia under the trade name Mirataine H2C-HA®.

Sulfobetaine surfactants are particularly preferred, since they can improve soap scum cleaning. Examples of suitable sulfobetaine surfactants include tallow bis(hydroxyethyl) sulphobetaine, cocoamido propyl hydroxy sulphobetaines which are commercially available from Rhodia and Witco, under the trade name of Mirataine CBS® and ReWoteric AM CAS 15® respectively.

Amphoteric surfactants can be either cationic or anionic depending upon the pH of the composition. Suitable amphoteric surfactants include dodecylbeta-alanine, N-alkyltaurines such as the one prepared by reacting dodecylamine with sodium isethionate, as taught in U.S. Pat. No. 2,658,072, N-higher alkylaspartic acids such as those taught in U.S. Pat. No. 2,438,091, and the products sold under the trade name "Miranol", as described in U.S. Pat. No. 2,528,378. Other suitable additional surfactants can be found in McCutcheon's Detergents and Emulsifers, North American Ed. 1980.

Suitable betaine and sulfobetaine surfactants are according to the formulae:

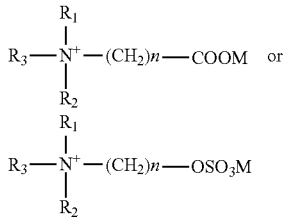

wherein: $R_1$ and $R_2$ are each independently linear or branched, saturated or unsaturated hydrocarbon chains of from 1 to 30 carbon atoms, preferably 1 to 20, more preferably 1 to 7 carbon atoms; $R_3$ is a linear or branched hydrocarbon chain of from 10 to 20 carbon atoms, preferably of from 10 to 18, more preferably 12 to 16 carbon atoms; n is an integer of from 1 to 20, preferably 1 to 10, more preferably 1 to 5; and M is H or an alkali metal, or mixtures thereof.

Suitable betaine surfactant include coconut-dimethyl betaine commercially available under tradename Mackam35® from McIntyre.

Carboxylated Fructan:

Fructans are described in S. Mitmesser and M. Combs, "Prebiotics: Inulin and Other Oligosaccharides", Ch 23, part C (Food Substrates Important to the Microbiota), The Microbiota in Gastrointestinal Pathophysiology, Academic Press, 2017. Fructans are a group of oligo- and polysaccharides composed of fructose units connected with β-(2→1) linkages, and frequently terminating in a glucosyl moiety (as described in Roberfroid M B, Van Loo J A, Gibson G R, "The bifidogenic nature of chicory inulin and its hydrolysis products.", J Nutr 1998; 128(1):11-9). The shortest members of this structural classification are called oligofructose (or FOS), and consist of 2-9 units, while fructans with 10 or more monomeric units are typically categorized as inulin. The number of units in a polysaccharide chain is also frequently referred to as degrees of polymerization (DP).

Many plants store carbohydrates in the form of inulin. Globe and Jerusalem artichokes, chicory, and agave are plants used for the commercial extraction of inulin, but other foods, such as wheat, bananas, onions, and garlic also contain inulin. Fructans can also be enzymatically synthesized from sucrose via transfructosylation. Chicory inulin is typically a linear beta (2->1) fructan (typically having a degree of polymerisation (DP) 2 to 60, with an average DP of typically 12.

Suitable carboxylated fructan include those described in WO2010106077 A as "component (II)", such as carboxylated fructan selected from the group consisting of: carboxyalkylfructan, preferably carboxyalkylinulin, having from 1 to 4 carbon atoms in the alkyl moiety; dicarboxyfructan having a degree of oxidation (DO) of from 10 to 100%, preferably 20 to 90%, expressed as a molar percentage of monosaccharide units converted into the corresponding dicarboxy analogues; 6-carboxyfructan, preferably 6-carboxyinulin; fructan polycarboxylic acid, preferably inulin polycarboxylic acid, having a degree of carboxyalkylation or carboxyacylation of from 0.2 to 3.0; and mixtures thereof.

Fructans used as starting material for producing the carboxylated fructans can be oligo- and polysaccharides which have a majority of anhydrofructose units, and can have a polydisperse chain length distribution and can be of straight- or branched-chain. Preferably the fructan contains mainly beta-2.1 bonds, as in inulin. The fructans used as starting material can be products obtained directly from a vegetable source or other sources as well as products in which the average chain length has been modified, increased or reduced, by fractionation, enzymatic synthesis or hydrolysis.

Carboxylated fructans with modified average chain length can be made from fructans with enzymatically increased chain length, fructanhydrolysis products having shortened chains and fractionated products having a modified chain length. Fractionating of fructans such as inulin can be achieved, for example, by means of known techniques including low temperature crystallization (see WO 96/01849), column chromatography (see WO 94/12541), membrane filtration (see EP-A-0440074, EP-A-0627490) or selective precipitation with alcohol. Hydrolysis to yield shorter fructans can be carried out, for example, enzymatically (endo-insulase), chemically (water and acid) or by heterogeneous catalysis (acid column). Reduced, oxidized, hydroxyalkylated and/or crosslinked fructans can also represent suitable starting materials to produce the carboxylated fructans. The fructans can have an average chain length (degree of polymerization, DP) of at least 3 to about 1000. Preferably, the average chain length is from 3 to 60, in particular of from 5 to 30 monosaccharide units. A preferred fructan is inulin (beta-2, 1-fructan) or a modified inulin.

Particularly suited fructan include carboxymethylinulin and/or carboxyethylinulin, preferably with a degree of substitution (DS) in the range of from 1.5 to 2.8, and/or dicarboxyinulin having a degree of oxidation (DO) of from 20 to 90%, expressed as a molar percentage of monosaccharide units converted into the corresponding dicarboxy analogues.

Carboxymethylinulin can be prepared by reaction of the fructan with chloroacetic acid as described in WO95/15984. Carboxylethylinulin can be prepared in accordance with the method of WO 96/34017. The carboxyalkylinulin so prepared can have a degree of substitution (DS) up to 3.0. The DS of such carboxyalkylinulins is generally within the range of from 0.2 to 3.0, preferably from 1.0 to 2.8. Preferred carboxy alkylinulins have a DS in the range of from 1.5 to 2.8, most preferably 1.8 to 2.5.

Dicarboxyinulins can be obtained through oxidation of the inulin raw material. The anhydrofructose units are converted, with ring opening, into dicarboxy(hydroxyethoxy) ethyleneoxy units. The oxidation can proceed in one step with hypohalite, as described in WO91/17189, or in two steps with periodate and chlorite, as described in WO95/12619. Preferred degrees of oxidation (DO) are in the range of from 20 to 90%, the DO being the (molar) percentage of monosaccharide units converted into the corresponding dicarboxy analogues.

6-Carboxy inulin is a well-known material. It can be obtained by oxidation in accordance with the method of WO 95/07303.

Fructan polycarboxylic acid can be prepared by successive oxidation and carboxyalkylation of the selected starting material. The material can have a DO of from 0.2 to 2.0 and a degree of carboxy-alkyl/-acyl substitution of from 0.2 to 3, preferably from 0.5 to 2.5.

Methods of making suitable carboxylated fructan are described in_WO2005/073256A1 and WO2013/117672A1.

The carboxylated fructan can be present at a level of from 0.005% to 2.0% by weight of the total composition, preferably from 0.01% to 1.0%, more preferably from 0.05% to 0.5% by weight of the composition.

Antimicrobial Agent:

Suitable antimicrobial agents include antimicrobial agents selected from the group consisting of: quaternary ammonium compound, and mixtures thereof.

The antimicrobial agent is required to be present in amounts which are effective in exhibiting satisfactory germicidal activity—against selected bacteria sought to be treated by the cleaning compositions. Such efficacy may be achieved against less resistant bacterial strains with only minor amounts of the antimicrobial agent being present, while more resistant strains of bacteria require greater amounts of the antimicrobial agent in order to destroy these more resistant strains. The antimicrobial agent need only be present in germicidally effective amounts, which can be as little as 0.001 wt %. In more preferred compositions, the antimicrobial hard surface cleaning composition comprises the antimicrobial agent at a level of from 0.01 to 2.0%, preferably from 0.05% to 1.6%, more preferably from 0.1% to 1.2%, most preferably from 0.25% to 0.9% by weight of the composition. A germicidally effective amount of the antimicrobial agent can be considered to result in at least a log 4.5, preferably at least a log 5 reduction of *Staphylococcus aureus*, using the method of EN1276 (Chemical Disinfectants Bactericidal Activity Testing), in less than 3 minutes.

The antimicrobial agent can be selected from the group consisting of: a quaternary ammonium compound, more preferably a quaternary ammonium compound selected from the group consisting of: C6 to C18 alkyltrimethylammonium chlorides, C6 to C18 dialkyldimethylammonium chlorides, C6 to C18 alkylbenzyldimethylammonium chloride, C6 to C18 alkyl dimethyl ethylbenzyl ammonium chloride, and mixtures thereof.

Suitable quaternary ammonium compounds are those of the formula:

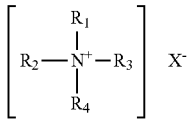

wherein at least one of $R_1$, $R_2$, $R_3$ and $R_4$ is a hydrophobic, aliphatic, aryl aliphatic or aliphatic 30 aryl radical of from 6 to 26 carbon atoms, and the entire cation portion of the molecule has a molecular weight of at least 165. The hydrophobic radical-s may be long-chain alkyl, long-chain alkoxy aryl, long-chain alkyl aryl, halogen-substituted long-chain alkyl aryl, long-chain alkyl phenoxy alkyl, aryl alkyl, etc. The remaining radicals on the nitrogen atoms other than the hydrophobic radicals are substituents of a hydrocarbon structure usually containing a total of no more than 12 carbon atoms. The radicals $R_1$, $R_2$, $R_3$ and $R_4$ may be straight chained or may be branched, but are preferably straight chained, and may include one or more amide or ester linkages. The radical X may be any salt-forming anionic radical, and preferably aids in the solubilization of the quaternary ammonium germicide in water. X can be a halide, for example a chloride, bromide or iodide, or X can be a methosulfate counterion, or X can be a carbonate ion. Exemplary quaternary ammonium compounds include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quaternary ammonium compounds include those in which the molecule contains either amide or ester linkages such as octyl phenoxy ethoxy ethyl dimethyl benzyl ammonium chloride, N-(laurylcocoaminoformylmethyl)-pyridinium chloride, and the like. Other very effective types of quaternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylbenzyltrimethyl ammonium chloride, chlorinated dodecylbenzyltrimethyl ammonium chloride, and the like.

More preferred quaternary ammonium compounds used in the compositions of the invention include those of the structural formula:

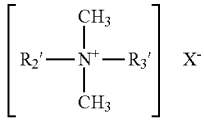

wherein $R_2'$ and $R_3'$ may be the same or different and are selected from C8-C12 alkyl, or $R_2'$ is C12-C16 alkyl, C8-C18 alkylethoxy, C8-C18 alkylphenolethoxy and $R_3'$ is benzyl, and X is a halide, for example a chloride, bromide or iodide, or X is a methosulfate counterion. The alkyl groups recited in $R_2'$ and $R_3'$ may be linear or branched, but are preferably substantially linear, or fully linear.

Particularly useful quaternary germicides include compositions presently commercially available under the tradenames BARDAC, and BARQUAT. These quaternary ammonium compounds are usually provided in a solvent, such as a C2 to C6 alcohol (such as ethanol, n-propanol, isopropanol, n-butanol, sec-butanol, and the like), glycols such as ethylene glycol, or in an mixtures containing water, such alcohols, and such glycols. Particularly preferred is didecyl dimethyl ammonium chloride, such as supplied by Lonza under tradenames such as: Bardac 2250™, Bardac 2270™, Bardac 2270E™, Bardac 2280™, and/or a blend of alkyl, preferably C12-C18, dimethyl benzyl ammonium chloride and alkyl, preferably C12-C18, dimethyl ethylbenzyl ammonium chloride, such as supplied by Lonza under the brand names: Barquat 4280Z™. In preferred embodiments, the alkyl dimethyl benzyl ammonium chloride and alkyl dimethyl ethylbenzyl ammonium chloride are present in a ratio of from 20:80 to 80:20, or 40:60 to 60:40, with a ratio of 50:50 being the most preferred.

Optional Ingredients:

The hard surface cleaning composition can comprise optional ingredients, such as those selected from the group consisting of: thickener, cleaning polymer, branched fatty alcohol, solvent, perfume, additional chelating agent, and mixtures thereof.

Thickener:

The liquid hard surface cleaning composition can comprise a thickener. An increased viscosity, especially low shear viscosity, provides longer contact time and therefore improved penetration of greasy soil and/or particulated greasy soil to improve cleaning effectiveness, especially when applied neat to the surface to be treated. Moreover, a high viscosity improved the contact time for the hard surface cleaning composition on inclined surfaces. The alkyl pyrrolidones of use in the present invention have been found to improve the viscosity of thickened hard surface cleaning compositions, and are hence particularly suited for cleaning inclined surfaces. Hence, the liquid hard surface cleaning compositions comprising a thickener can have a viscosity from 1 cps to 650 cps, more preferably of from 100 cps to 550 cps, more preferably from 150 cps to 450 cps, even more preferably from 150 cps to 300 cps and most preferably from 150 cps to 250 cps when measured at 20° C. with a AD 1000 Advanced Rheometer from Atlas® shear rate 10 $s^{-1}$ with a coned spindle of 40 mm with a cone angle 2° and a truncation of ±60 μm.

Suitable thickeners include polyacrylate based polymers, preferably hydrophobically modified polyacrylate polymers; hydroxyl ethyl cellulose, preferably hydrophobically modified hydroxyl ethyl cellulose, xanthan gum, hydrogenated castor oil (HCO) and mixtures thereof.

Preferred thickeners are polyacrylate based polymers, preferably hydrophobically modified polyacrylate polymers. Preferably a water-soluble copolymer based on main monomers acrylic acid, acrylic acid esters, vinyl acetate, methacrylic acid, acrylonitrile and mixtures thereof, more preferably copolymer is based on methacrylic acid and acrylic acid esters having appearance of milky, low viscous dispersion. Most preferred hydrologically modified polyacrylate polymer is Rheovis® AT 120, which is commercially available from BASF.

Other suitable thickeners are hydroxethylcelluloses (HM-HEC) preferably hydrophobically modified hydroxyethylcellulose. Suitable hydroxethylcelluloses (HM-HEC) are commercially available from Aqualon/Hercules under the product name Polysurf 76® and W301 from 3V Sigma.

Xanthan gum is one suitable thickener used herein. Xanthan gum is a polysaccharide commonly used rheology modifier and stabilizer. Xanthan gum is produced by fermentation of glucose or sucrose by the *Xanthomonas camp-*

*estris* bacterium. Suitable Xanthan gum is commercially available under trade name Kelzan T® from CP Kelco.

Hydrogenated castor oil is one suitable thickener used herein. Suitable hydrogenated castor oil is available under trade name THIXCIN R from Elementis.

The most preferred thickener used herein is a modified methacrylic acid/acrylic acid copolymer Rheovis® AT 120, which is commercially available from BASF.

When used, the liquid hard surface cleaning composition comprises from 0.1% to 10.0% by weight of the total composition of said thickener, preferably from 0.2% to 5.0%, more preferably from 0.2% to 2.5% and most preferably from 0.2% to 2.0%.

Since additional ingredients can reduce surface shine, in more preferred embodiments, the hard surface cleaning composition does not comprise any thickener.

Cleaning Polymer:

The antimicrobial liquid hard surface cleaning composition may comprise a cleaning polymer. It has been found that the presence of a specific cleaning polymer as described herein, when present, allows further improvement of the grease removal performance of the liquid composition due to the specific sudsing/foaming characteristics they provide to the composition and/or their surface modification behaviour.

The polymer can be selected from the group consisting of: a vinylpyrrolidone homopolymer (PVP); a polyethyleneglycol dimethylether (DM-PEG); a vinylpyrrolidone/dialkylaminoalkyl acrylate or methacrylate copolymers; a polystyrenesulphonate polymer (PSS); a poly vinyl pyridine-N-oxide (PVNO); a polyvinylpyrrolidone/vinylimidazole copolymer (PVP-VI); a polyvinylpyrrolidone/polyacrylic acid copolymer (PVP-AA); a polyvinylpyrrolidone/vinylacetate copolymer (PVP-VA); a polyacrylic polymer or polyacrylic maleic copolymer; and a polyacrylic or polyacrylic maleic phosphono end group copolymer; a polyethyleneimine polymer such as carboxylated polyethyleneimine; and mixtures thereof.

Polyethyleneimine polymers such as carboxylated polyethyleneimine are particularly preferred as they have been found to further improve surface shine. Suitable polyethyleneimine polymers may be linear or branched, charged or uncharged. They may be hyperbranched or have a dendritic form. They may contain primary, secondary, and/or tertiary amino groups. They are carboxylated by reaction with fatty acids, carboxylic acid and/or carboxylic acid derivatives (such as acrylic acid, maleic acid, maleic anhydride, etc.). They may be alkoxylated, amidated, etc. They may be amphiphilic, amphoteric, alkoxylated, etc. In some embodiments, they may have molecular weights of from about 300 to about 2,000,000. Examples of suitable polyethyleneimine polymers include materials sold by BASF under the trade name Lupasol® and by Nippon Shokubai under the trade name EPOMIN. Examples include Lupasol® FG, Lupasol® G 20, Lupasol® G 35, Lupasol® G 100, Lupasol® G 500, Lupasol® HF, Lupasol® P, Lupasol® PS, Lupasol® PR 8515, Lupasol® WF, Lupasol® FC, Lupasol® PE, Lupasol® HEO 1, Lupasol® PN 50, Lupasol® PN 60, Lupasol® PO 100, Lupasol® SK, etc.

Typically, the liquid hard surface cleaning composition may comprise from 0.005% to 5.0% by weight of the total composition of said polymer, preferably from 0.01% to 4.0%, more preferably from 0.1% to 3.0% and most preferably from 0.20% to 1.0%.

Since additional ingredients can reduce surface shine, in more preferred embodiments, the hard surface cleaning composition does not comprise any cleaning polymer, with the exception of carboxylated polyethyleneimines.

Branched Fatty Alcohol:

The liquid hard surface cleaning composition may comprise a branched fatty alcohol, particularly as suds suppressors. Suitable branched fatty alcohols include the 2-alkyl alkanols having an alkyl chain comprising from 6 to 16, preferably from 7 to 13, more preferably from 8 to 12, most preferably from 8 to 10 carbon atoms and a terminal hydroxy group, said alkyl chain being substituted in the at position (i.e., position number 2) by an alkyl chain comprising from 1 to 10, preferably from 2 to 8 and more preferably 4 to 6 carbon atoms. Such suitable compounds are commercially available, for instance, as the Isofol® series such as Isofol® 12 (2-butyl octanol) or Isofol® 16 (2-hexyl decanol) commercially available from Sasol Typically, the liquid hard surface cleaning composition may comprise up to 2.0% by weight of the total composition of said branched fatty alcohol, preferably from 0.10% to 1.0%, more preferably from 0.1% to 0.8% and most preferably from 0.1% to 0.5%.

Solvent:

The liquid hard surface cleaning compositions may comprise a solvent or mixtures thereof.

Suitable solvents may be selected from the group consisting of: ethers and diethers having from 4 to 14 carbon atoms; glycols or alkoxylated glycols; alkoxylated aromatic alcohols; aromatic alcohols; alkoxylated aliphatic alcohols; aliphatic alcohols; $C_8$-$C_{14}$ alkyl and cycloalkyl hydrocarbons and halohydrocarbons; $C_6$-$C_{16}$ glycol ethers; terpenes; and mixtures thereof. Ethers such as n-butoxypropanol and glycol ethers such as dipropylene glycol n-butyl ether are particularly preferred.

When present, the solvent can be present at a level of from 0.1 to 10%, or 0.2 to 5.0%, or 0.5 to 3% by weight of the composition.

Additional Chelating Agent:

The liquid hard surface cleaning composition can comprise an additional chelating agent. Chelating agents are ingredients which are primarily added to sequester metal ions. Chelating agents typically sequester such metal ions through the formation of two or more separate coordinate bonds between a polydentate (multiple bonded) ligand and a single central (metal) atom. Such ligands are typically organic compounds.

Suitable additional chelating agents include: amino-carboxylates (such as diethylenetriaminepentaacetic acid [DTPA]), phosphonate chelating agents, and mixtures thereof.

Preferably, the hard surface cleaning composition comprises less than 0.1%, preferably less than 0.05% of additional chelant. More preferably, the composition comprises no additional chelating agent. It has been found that higher levels of additional chelating agent reduce surface shine.

Perfumes:

The liquid hard surface cleaning compositions preferably comprise a perfume. Suitable perfumes provide an olfactory aesthetic benefit and/or mask any "chemical" odour that the product may have. The most preferred perfumes are those that deliver a high perfume intensity and longevity.

Other Optional Ingredients:

The liquid hard surface cleaning compositions may comprise a variety of other optional ingredients depending on the technical benefit aimed for and the surface treated. Suitable optional ingredients of use herein include builders, other polymers, buffers, bactericides, hydrotropes, colorants, stabilisers, radical scavengers, abrasives, soil suspenders, brighteners, anti-dusting agents, dispersants, dye transfer inhibitors, pigments, silicones and/or dyes.

Wipe or Pad

The hard surface cleaning composition can be comprised in an article of manufacture, such as a spray dispenser, or in a wipe or pad. Suitable wipes can be fibrous. Suitable fibrous wipes can comprise polymeric fibres, cellulose fibres, and combinations thereof. Suitable cellulose-based wipes include kitchen wipes, and the like. Suitable polymeric fibres include polyethylene, polyester, and the like. Polymeric fibres can be spun-bonded to form the wipe. Methods for preparing thermally bonded fibrous materials are described in U.S. application Ser. No. 08/479,096 (Richards et al.), filed Jul. 3, 1995 (see especially pages 16-20) and U.S. Pat. No. 5,549,589 (Horney et al.), issued Aug. 27, 1996 (see especially Columns 9 to 10). Suitable pads include foams and the like, such as HIPE-derived hydrophilic, polymeric foam. Such foams and methods for their preparation are described in U.S. Pat. No. 5,550,167 (DesMarais), issued Aug. 27, 1996; and commonly assigned U.S. patent application Ser. No. 08/370,695 (Stone et al.), filed Jan. 10, 1995.

Method of Cleaning a Surface:

The compositions described herein are particularly suited for cleaning surfaces selected from the group consisting of: ceramic tiles, enamel, stainless steel, Inox®, Formica®, vinyl, no-wax vinyl, linoleum, melamine, glass, plastics and plastified wood, and combinations thereof. The compositions of the present invention are particularly suited for improving shine or preventing water-marks, and combinations thereof. When the formula is thickened, they are particularly suited for improving shine and/or preventing water-marks from inclined surfaces, especially when the composition is applied as a spray, or applied using a wipe or pad.

The preferred method of cleaning comprises the steps of:

a) providing a hard surface cleaning composition of the present invention;
b) applying the hard surface cleaning composition to a hard surface;
c) optionally rinsing and/or wiping the surface.

The hard surface cleaning composition may be diluted to a level of from 0.1% to 2.0%, or from 0.3% to 1.5% by volume. The composition may be diluted to a level of from 0.4% to 0.6% by volume, especially when the composition has a total surfactant level of greater than or equal to 5% by weight. Where the composition has a total surfactant level of less than 5% by weight, the composition may be diluted to a level of from 0.7% to 1.4% by volume. In preferred embodiments, the composition is diluted with water.

The dilution level is expressed as a percent defined as the fraction of the alkaline liquid hard surface cleaning composition, by volume, with respect to the total amount of the diluted composition. For example, a dilution level of 5% by volume is equivalent to 50 ml of the composition being diluted to form 1000 ml of diluted composition.

The diluted composition can be applied by any suitable means, including using a mop, sponge, cloth, wipe, pad, or other suitable implement.

Alternatively, the alkaline liquid hard surface cleaning composition can be a "ready-to-use" composition, where dilution is not necessary. Such ready-to-use compositions can be comprised in a spray container.

In addition, for particularly dirty or greasy spots, the alkaline liquid hard surface cleaning composition can be applied neat to the hard surface. The compositions of the present invention provide improved penetration and removal of the stain, and especially of greasy stains, leading to improved surfactancy action and stain removal.

By "neat", it is to be understood that the liquid composition is applied directly onto the surface to be treated without undergoing any significant dilution, i.e., the liquid composition herein is applied onto the hard surface as described herein, either directly or via an implement such as a sponge, without first diluting the composition. By "without undergoing any significant dilution", what is meant is that the composition is diluted by less than 10 wt %, preferably less than 5 wt %, more preferably less than 3 wt %. Such dilutions can arise from the use of damp implements to apply the composition to the hard surface, such as sponges which have been "squeezed" dry.

In another preferred embodiment of the present invention said method of cleaning a hard surface includes the steps of applying, preferably spraying, said liquid composition onto said hard surface, leaving said liquid composition to act onto said surface for a period of time to allow said composition to act, with or without applying mechanical action.

The compositions of the present invention have been found to improve surface shine, even in the presence of soft-water. That is, formulating the hard surface cleaning composition with the carboxylated fructan provides improved surface shine, even when the carboxylated fructan is not acting as a chelating agent. As such, the hard surface cleaning composition can be first diluted with water, even soft water, for instance having a water having a water hardness of less than 1.5 mmol/l, or less than 1.0 mmol/l, or less than 0.5 mmol/l.

Methods:

A) pH Measurement:

The pH is measured on the neat composition, at 25° C., using a Sartarius PT-10P pH meter with gel-filled probe (such as the Toledo probe, part number 52 000 100), calibrated according to the instructions manual.

B) Shine:

The composition was diluted to a level of 0.48 wt % using water having the desired hardness level.

Black glossy tiles (20 cm×25 cm reference H07300 Sphinx ceramic tiles) are soaked in a nil-polymer APC solution overnight, rinsed and dried. The tiles are sprayed with a soil blend comprising vegetable oil, polymerized vegetable oil, sugar and house dust (18:2:29:51 blend in isopropanol alcohol) until 0.015 g of the soil has been applied and the tile dried. The tiles are then cleaned using a non-woven cloth soaked in the diluted cleaning solution, first horizontally, then vertically, and then again horizontally. The cloth is then rinsed in the diluted cleaning solution, and the tiles cleaned in the same manner, using the other side of the nonwoven cloth.

The tiles are then graded using the grading scale described below. A lower value means better shine:

Grading scale:

0=as new/no streaks and/or film
1=very slight streaks and/or film
2=slight streaks and/or film
3=slight to moderate streaks and/or film
4=moderate streaks and/or film
5=moderate/heavy streaks and/or film
6=heavy streaks and/or film

EXAMPLES

The following compositions were made by simple mixing and evaluated for shine performance when using hard water having a water-hardness of 2.4 mmol/l:

| | Ex A* wt % | Ex 1 wt % | Ex B* wt % |
|---|---|---|---|
| C9/11 EO8[1] | 6.2 | 6.2 | 6.2 |
| HLAS | 1.80 | 1.80 | 1.80 |
| C12-14 Amine Oxide[2] | 1.50 | 1.50 | 1.50 |
| Topped palm kernel fatty acid | 0.40 | 0.40 | 0.40 |
| $Na_2CO_3$ | 0.55 | 0.55 | 0.55 |
| Citric Acid | 0.30 | 0.30 | 0.30 |
| Topped palm kernel fatty acid | 0.40 | 0.40 | 0.4 |
| DTPA[3] | 0.50 | — | — |
| Carboxylated fructan[4] | — | 0.5 | — |
| Perfume | 1.10 | 1.10 | 1.10 |
| Hydrophobically modified-polyacrylate[5] | 0.9 | 0.9 | 0.9 |
| Sodium hydroxide | to pH 10.3 | to pH 10.3 | to pH 10.3 |
| Minors and Water | to 100% | to 100% | to 100% |
| Absolute shine PSU (lower the better) | 5.5 | 3.0 | 4.75 |

*Comparative

[1]nonionic surfactant commercially available from Shell

[2]amine oxide nonionic surfactant, supplied by Huntsman

[3]diethylene triamine pentaacetic acid, an aminocarboxylate chelant supplied by Dow chemical

[4]a carboxymethyl inulin, available from ItalMatch ® under the trade name FS 1502

[5]Rheovis ® AT120 stucturant commercially available from BASF

As can be seen from comparing the results from example 1 with comparative example A, the composition of the present invention, comprising a carboxylated fructan, results in a surprising improvement in surface shine. This is particularly surprising since the addition of a chelant typically results in a reduction in surface shine, as can be seen by comparing the shine results of comparative example A (comprising the alternative chelating agent) with comparative example B (not comprising a chelant).

The following compositions were made by simple mixing and evaluated for shine performance when using soft water having a water-hardness of 0.68 mmol/l:

| | Ex C* wt % | Ex 2 wt % | Ex D* wt % |
|---|---|---|---|
| C9/11 EO8[1] | 2.0 | 2.0 | 2.0 |
| HLAS | 0.3 | 0.3 | 0.3 |
| C12-14 Amine Oxide[2] | 0.1 | 0.1 | 0.1 |
| $Na_2CO_3$ | 0.4 | 0.4 | 0.4 |
| Citric Acid | 0.3 | 0.3 | 0.3 |
| DTPA[3] | 0.1 | — | — |
| Carboxylated fructan[4] | — | 0.1 | — |
| Perfume | q.s. | q.s. | q.s. |
| Sodium hydroxide | to pH 10.3 | to pH 10.3 | to pH 10.3 |
| Minors and Water | to 100% | to 100% | to 100% |
| Absolute shine PSU (lower the better) | 4.0 | 2.2 | 4.0 |

The shine results from example 2 and comparative examples C and D show that reducing the surfactant level leads to an improvement in shine, since lower levels of surfactant residue are left on the surface. However, even with the reduced surfactant levels, and even when using soft water, the compositions of the present invention, comprising the carboxylated fructan, result in an improved shine, both in comparison to a composition comprising an alternative chelant (example C), and in comparison to nil-chelant comparative formulae.

The following compositions were made by simple mixing and evaluated for shine performance when using soft water having a water-hardness of 0.68 mmol/l:

| | Ex E* wt % | Ex 3 wt % |
|---|---|---|
| C9/11 EO8[1] | 3.0 | 3.0 |
| HLAS | 0.45 | 0.45 |
| C12-14 Amine Oxide[2] | 0.15 | 0.15 |
| $Na_2CO_3$ | 0.40 | 0.40 |
| Citric Acid | 0.3 | 0.3 |
| DTPMP[6] | 0.2 | — |
| Carboxylated fructan[4] | — | 0.2 |
| Perfume | q.s. | q.s. |
| Sodium hydroxide | to pH 10.3 | to pH 10.3 |
| Minors and Water | to 100% | to 100% |
| Absolute shine PSU (lower the better) | 3.0 | 2.0 |

[6]Diethylenetriaminepenta(methylene-phosphonic acid) commercially available from Therm Phos international BV By comparing the shine results from example 3 with comparative example E, the improvement in shine is also evident in comparison to compositions comprising phosphonic acid-based chelants.

The following compositions were made by simple mixing and evaluated for shine performance when using soft water having a water-hardness of 0.68 mmol/l:

| | Ex F* wt % | Ex 4 wt % | Ex 5 wt % |
|---|---|---|---|
| C9/11 EO8[1] | 2.34 | 2.34 | 2.34 |
| C12-14 Amine Oxide[2] | 0.36 | 0.36 | 0.36 |
| $Na_2CO_3$ | 0.50 | 0.50 | 0.50 |
| Citric Acid | 0.2 | 0.2 | 0.2 |
| DTPA[3] | 0.1 | — | — |
| Carboxylated fructan[4] | — | 0.1 | 0.1 |
| Carboxylated polyethyleneimine[7] | — | — | 0.2 |
| DDAC[8] | 0.14 | 0.14 | 0.14 |
| Perfume | q.s. | q.s. | q.s. |
| Monoethanolamine | to pH 10.3 | to pH 10.3 | to pH 10.3 |
| Minors and Water | to 100% | to 100% | to 100% |
| Absolute shine PSU (lower the better) | 4.5 | 3.0 | 2.0 |

[7]sold under the tradename of Lupasol ™ PN60, by BASF

[8]didecyl dimethyl ammonium chloride, supplied under the trade name Bardac 2280 by Lonza By comparing the shine results from example 4 with comparative example F, the improvement in shine is also evident in compositions comprising an antimicrobial agent. By comparing the shine results from example 5 with example 4, the additional benefit of incorporating a carboxylated polyethyleneimine can be seen.

The following are further examples of the present invention:

| | Ex 6 wt % | Ex 7 wt % | Ex 8 wt % | Ex 9 wt % | Ex 10 wt % |
|---|---|---|---|---|---|
| C9/11 EO8[1] | 0.97 | 2.00 | 6.20 | 4.20 | 0 |
| C12-14 Amine oxide[1] | 0.055 | 1.00 | 1.50 | 0.40 | 0 |
| N-Octyl-2-Pyrrolidone[9] | 0 | 1.00 | 0 | 2.00 | 1.50 |
| Alkyl polyglycoside[10] | 0 | 0 | 0 | 0 | 5.7 |
| HLAS | 0 | 1.0 | 0 | 0 | 0 |
| C10-C18 Alkyl dimethyl carboxymethyl betaine | 0 | 0 | 0 | 0 | 3.2 |
| Coconut fatty Acid | 0 | 0 | 0.4 | 0.3 | 0.5 |
| Carboxylated fructan[4] | 0 | 0.1 | 0 | 0 | 0 |
| Sodium carbonate | 0.017 | 0.10 | 0.55 | 0.55 | 0.4 |
| Monoethanolamine | 0.75 | 0.50 | 0 | 0 | 0.50 |
| Citric acid | 0.05 | 0.30 | 0 | 0.10 | 0.15 |
| n-BPP[11] | 0 | 0 | 0 | 2.00 | 0 |

-continued

| | Ex 6 wt % | Ex 7 wt % | Ex 8 wt % | Ex 9 wt % | Ex 10 wt % |
|---|---|---|---|---|---|
| Carboxylated polyethyleneimine[7] | 0.05 | 0 | 0 | 0 | 0 |
| Perfume | 0.10 | 0.35 | 1.0 | 1.0 | 0.80 |
| Polymeric thickener[5] | 0 | 0 | 0.97 | 0.97 | 0 |
| Sodium hydroxide to pH | 11.1 | 10.5 | 10.3 | 10.8 | 10.8 |

[9]supplied under the trade name Surfadone ™ LP-100 by Ashland
[10]Glucopon ™ 425N, supplied by BASF
[11]Dipropylene Glycol n-Butyl Ether The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A hard surface cleaning composition comprising:

(a) from 0.5% to 7.5% by weight of a surfactant system; and (b) from 0.005% to 0.5% by weight of the total hard surface cleaning composition of a carboxylated fructan, wherein the carboxylated fructan is selected from the group consisting of: carboxyalkylinulin having from 3 to 4 carbon atoms in the alkyl moiety, dicarboxyfructan having a degree of oxidation (DO) of from 10 to 100% expressed as a molar percentage of monosaccharide units converted into the corresponding dicarboxy analogues, and mixtures thereof; and wherein the surfactant system comprises from 0.1% to 2.5% by weight of the hard surface cleaning composition of alkoxylated nonionic surfactant and from 0.005% to 0.5% by weight of the hard surface cleaning composition of amine oxide surfactant, wherein the hard surface cleaning composition further comprises at least 0.001% by weight of the hard surface cleaning composition of a quaternary ammonium compound.

2. The hard surface cleaning composition according to claim 1, wherein the composition further comprises a carboxylated polyethyleneimine.

3. The hard surface cleaning composition according to claim 2, wherein the carboxylated polyethyleneimine is present at a level of from 0.005% to 5.0% by weight of the hard surface cleaning composition.

4. The hard surface cleaning composition according to claim 1, wherein the hard surface cleaning composition has a pH of greater than 7.0, measured on the neat hard surface cleaning composition, at 25° C.

5. The hard surface cleaning composition according to claim 1, wherein the hard surface cleaning composition does not comprise a further chelant.

6. A method of cleaning a hard surface, comprising the steps of:

(c) providing a hard surface cleaning composition according to claim 1;

(d) applying the hard surface cleaning composition to the hard surface; and (e) optionally rinsing and/or wiping the surface.

7. The hard surface cleaning composition according to claim 1, wherein the hard surface cleaning composition comprises from 0.005% to 0.05% by weight of the total hard surface cleaning composition of the carboxylated fructan.

8. A hard surface cleaning composition comprising:

(a) from 0.5% to 7.5% by weight of a surfactant system; and (b) from 0.005% to 0.05% by weight of the total hard surface cleaning composition of a carboxylated fructan, wherein the surfactant system comprises from 0.1% to 2.5% by weight of the hard surface cleaning composition of alkoxylated nonionic surfactant and from 0.005% to 0.5% by weight of the hard surface cleaning composition of amine oxide surfactant, wherein the hard surface cleaning composition further comprises at least 0.001% by weight of the hard surface cleaning composition of a quaternary ammonium compound.

* * * * *